US006519957B2

(12) United States Patent
Huh et al.

(10) Patent No.: US 6,519,957 B2
(45) Date of Patent: Feb. 18, 2003

(54) METHOD FOR CONTROLLING AIR CONDITIONER HAVING MULTI-COMPRESSOR

(75) Inventors: Deok Huh, Kyounggi-do (KR); Yun Ho Ryu, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/964,427

(22) Filed: Sep. 28, 2001

(65) Prior Publication Data

US 2002/0134094 A1 Sep. 26, 2002

(30) Foreign Application Priority Data

Mar. 26, 2001 (KR) ..... 01-15698

(51) Int. Cl.[7] ..... F25B 7/00; F25B 19/00
(52) U.S. Cl. ..... 62/175; 62/231
(58) Field of Search ..... 62/175, 157, 231, 62/196.2

(56) References Cited

U.S. PATENT DOCUMENTS 4,612,776 A * 9/1986 Alsenz ..... 62/175
5,050,397 A * 9/1991 Sugiyama et al. ..... 62/175
5,123,256 A * 6/1992 Oltman ..... 62/175
5,170,636 A * 12/1992 Hitosugi ..... 62/175
6,330,804 B1 * 12/2001 Uno et al. ..... 62/175

* cited by examiner

*Primary Examiner*—Denise L. Esquivel
*Assistant Examiner*—Marc Norman
(74) *Attorney, Agent, or Firm*—Birch, Stewart, Kolasch & Birch, LLP

(57) ABSTRACT

Disclosed is a method for controlling an air conditioner having a multi-compressor. The method comprises the steps of: first determining, in order to accomplish a set temperature after a user starts the air conditioner, a cooling load of a room by measuring an on-time for which at least two compressors are run, in a manner such that the more the one-time of the compressors is long, the more the cooling load of the room is judged to be large; and operating the air conditioner by changing a compressing capacity of the compressors in response to a first determined cooing load, in a manner such that, when the cooling load is large, the air conditioner is operated by a first combination of compressors, having a large compressing capacity, and, when the cooling load is small, the air conditioner is operated by a second combination of compressors, having a small compressing capacity.

20 Claims, 4 Drawing Sheets

| Set temperature~ Desired temperature | Running frequency of compressor |
|---|---|
| 2.5 ℃ and higher | H6 |
| 2.0 ~ 2.49 ℃ | H5 |
| 1.5 ~ 1.99 ℃ | H4 |
| 1.0 ~ 1.49 ℃ | H3 |
| 0.5 ~ 0.99 ℃ | H2 |
| 0.0 ~ 0.49 ℃ | H1 |

METHOD FOR CONTROLLING AIR CONDITIONER HAVING MULTI-COMPRESSOR

BACKGROUND OF THE INVENTION

1. Field of the Invention

The present invention relates to an air conditioner, and more particularly, the present invention relates to a method for controlling a plurality of compressors in an air conditioner to which a multi-compressor is applied in a manner such that a plurality of compressors are adopted as a compressing means for compressing refrigerant to allow an air conditioner to operate efficiently.

2. Description of the Related Art

FIG. 1 is a systematic view illustrating a construction of a conventional air conditioner.

Referring to FIG. 1, the conventional air conditioner includes a compressor 11 for compressing refrigerant, a condenser 12 for removing heat from compressed refrigerant and dissipating removed heat to the outside, an expander 13 for expanding liquid refrigerant of a high pressure, and an evaporator 14 for evaporating expanded refrigerant to absorb heat so that a room temperature can be lowered. The refrigerant that passes through the evaporator 14, is fed back into the compressor 11 to complete the cycle. Since the condenser 12 and the evaporator 14 are equipped with fans thereby exposed to wind current, heat exchange can be smoothly executed.

The operation of the conventional air conditioner according to the aforementioned construction is described hereinafter. As mentioned above, when the refrigerant is compressed by the compressor 11, a vaporous refrigerant of the high temperature and pressure is discharged from the compressor 11. The liquid refrigerant of a high pressure is discharged from the condenser 12 as the vaporous refrigerant of high temperature and pressure is deprived of heat in the condenser 12, and the liquid refrigerant, which has been passed through the condenser 12, is expanded by the expander 13 becoming the refrigerant of low temperature and pressure. In the evaporator 14, the heat is transferred to the refrigerant of the low temperature expanded by the expander 13, causing the temperature of the area surrounding the evaporator 14 to decrease. Thus, the function of the air conditioner has been fully performed. The refrigerant that consumed the heat while passing through the evaporator 14, is fed back into the compressor 11 to be compressed again.

On the other hand, the air conditioner as described above in which a constant-speed compressor is adopted as the compressor, a room temperature is lowered when the air conditioner is operated by power supplied thereto, and the heat is quickly absorbed and removed by the evaporator 14 and the condenser 12, respectively. When the room temperature reaches the temperature set up in advance by a user and the room temperature is longer needs to be lowered, then the compressor 11, the evaporator 14 and the condenser 12 stop operating causing the room temperature to rise again.

FIG. 2 is a graph illustrating a room temperature change in a conventional air conditioner that adopts a constant-speed compressor. Referring to FIG. 2, an initial operation of the air conditioner rapidly drops the room temperature, and if the room temperature falls below the set temperature T1 and reaches the lower limit temperature T2 due to a rapid cooling occurrence, the operation of the air conditioner is interrupted (see section A).

Further, as the compressor 11 and the other parts of the air conditioner stop running at the lower limit temperature T2, the operation of the air conditioner is interrupted. Although the inside heat is not discharged to the outside, the room temperature rises as the heat is transferred to the inside of the room from the outside. Thereafter, when the room temperature rises beyond the set temperature T1 and reaches the upper limit temperature T3, the compressor 11 starts to operate again (see section B). As the room temperature reaches the upper limit temperature T3 and the compressor 11 and the other parts of the air conditioner begins operate again, the room temperature drops. Thereafter, as a room temperature drops below the set temperature T1 and reaches the lower limit temperature T2 again, the compressor 11 is deactivated, and heat discharge to the outside is suspended (see section C).

In the above descriptions, other than the initial operation period, the section A, the section B process in which the compressor 11 and other parts are deactivated causing a room temperature rises and the section C process in which the compressor 11 and the other parts are in an operation mode to make a room temperature to drop, are repeated. In this way, a room temperature is adequately adjusted. Hence, even if the air conditioner is in the operation mode, from the set temperature T1 the room temperature continues to shift between the upper limit temperature T3 and the lower limit temperature to maintain the room temperature.

This phenomenon where a room temperature fluctuates within a predetermined range between T2 and T3 while the air conditioner is operated, is called a hunting phenomenon. This hunting phenomenon results the room temperature to be unstably maintained, causing an inconvenience to the user of the air conditioner.

Although it may be possible to reduce the range between the lower limit temperature T2 and the Upper limit temperature T3 to minimize the temperature changes sensed by the user, frequent deactuations of the compressor 11 is resulted. Moreover, these frequent deactuations of the compressor 11 result in a problem in terms of efficiency since a great amount of energy is required for initial actuating of the compressor 11. Thus, reducing the hunting phenomenon may result in increase of the power consumption.

To cope with the aforementioned problem, a method for reducing the hunting phenomenon to ensure delightfulness and comfortableness of the user while reducing power consumption has been introduced. In this method, instead of the constant-speed compressor, a variable-speed compressor which is equipped with an inverter circuit, is adopted. By this, a compressing capability of a compressor can be changed depending upon a heat discharging load, in a manner such that the compressor is not frequently deactuated.

FIG. 3 is a chart for explaining an actuation of a conventional variable-speed compressor which is equipped with an inverter circuit.

Referring to FIG. 3, after an air conditioner is initially operated, if a difference between a set temperature which is set in advance by a user and a room temperature is no less than 2.5° C., heat must be quickly discharged to the outside, and, to this end, the variable-speed compressor is actuated at a frequency of H6 which is a highest frequency under which the variable-speed compressor can be actuated. If the difference is between 2.0 and 2.49° C., the variable-speed compressor is actuated at a frequency of H5 which is lower, by one step, than H6. Consequently, as a difference between the set temperature and a room temperature is gradually decreased, an actuating frequency of the variable-speed compressor is decreased. That is, if a difference is between 0 and 0.49° C., the variable-speed compressor is actuated at a frequency of H1 which is a lowest frequency under which the variable-speed compressor can be actuated. Hence, the air conditioner is operated while an actuating frequency of the variable-speed compressor is changed depending upon a cooling load.

In the air conditioner to which the variable-speed compressor is applied, since a temperature is gradually and smoothly changed, the hunting phenomenon does not occur, and power consumption due to repetitive on/off switching of the compressor can be avoided.

However, the air conditioner, having applied thereto the variable-speed compressor, has a drawback in that, since the air conditioner includes the inverter circuit and the variable-speed compressor so as to be speed-variably controlled in its operation, a manufacturing cost is increased. Due to this drawback, the air conditioner having the variable-speed compressor is hardly used unless an air conditioner having a high compressing capability is required for precise temperature control.

SUMMARY OF THE INVENTION

Accordingly, the present invention has been made in an effort to solve the problems occurring in the related art, and an object of the present invention is to provide a method for controlling an air conditioner having a multi-compressor in which air conditioner a plurality of compressors are used in place of costly equipment such as a variable-speed compressor, for compressing refrigerant, whereby an actuation of the multi-compressor is properly controlled in a manner such that the air conditioner can be operated in a more effective way.

In order to achieve the above object, according to one aspect of the present invention, there is provided a method for controlling an air conditioner having a multi-compressor, comprising the steps of: first determining, in order to accomplish a set temperature after a user starts the air conditioner, a cooling load of a room by measuring an on-time for which at least two compressors are run, in a manner such that the more the on-time of the compressors is long, the more the cooling load of the room is judged to be large; and operating the air conditioner by changing a compressing capacity of the compressors in response to a first determined cooing load, in a manner such that, when the cooling load is large, the air conditioner is operated by a first combination of compressors, having a large compressing capacity, and, when the cooling load is small, the air conditioner is operated by a second combination of compressors, having a small compressing capacity.

By the feature of the present invention, the method for controlling an air conditioner having a multi-compressor provides advantages in that, since respective compressors having different compressing capacities are properly selected and actuated, reduction in power consumption and proper control of a room temperature can be simultaneously attained.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
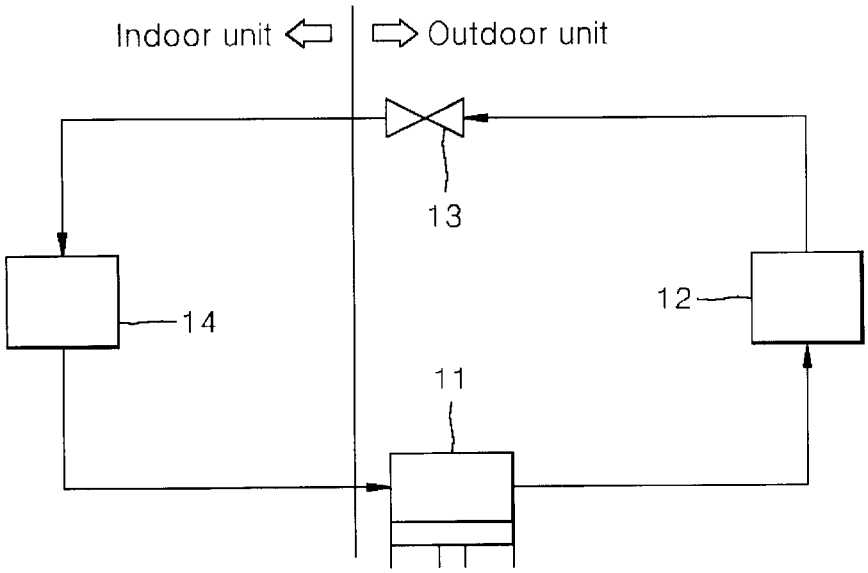
FIG. 1 (BACKGROUND ART)
FIG. 1 is a systematic view for illustrating a construction of a conventional air conditioner.
Figure 2:
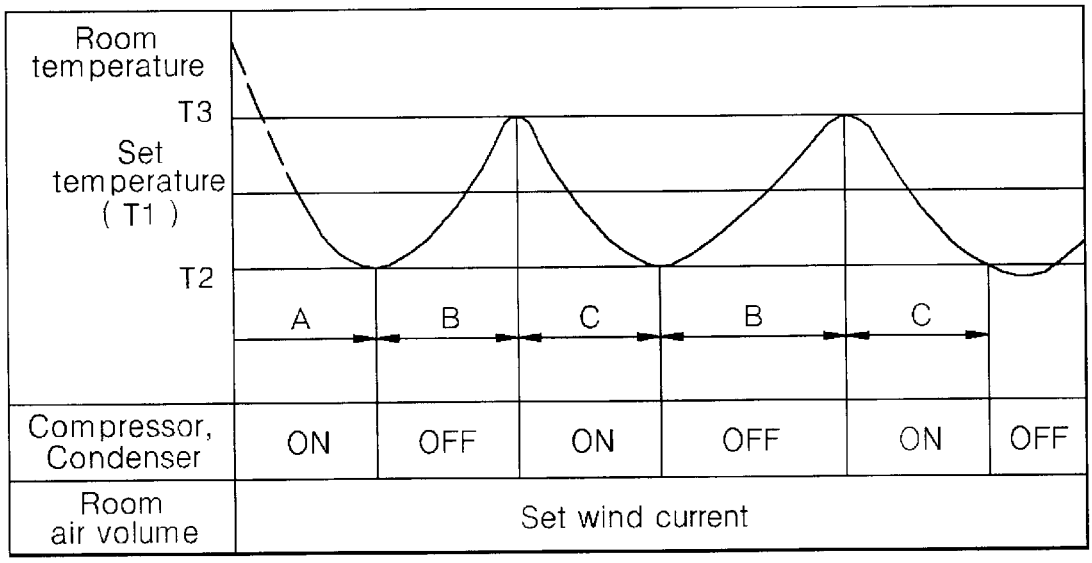
FIG. 2 (BACKGROUND ART)
FIG. 2 is a graph illustrating a room temperature change in a conventional air conditioner which adopts a constantspeed compressor.

Reference will now be made in greater detail to a preferred embodiment of the invention, an example of which is illustrated in the accompanying drawings. Wherever possible, the same reference numerals will be used throughout the drawings and the description to refer to the same or like parts.

Figures 3, 4:
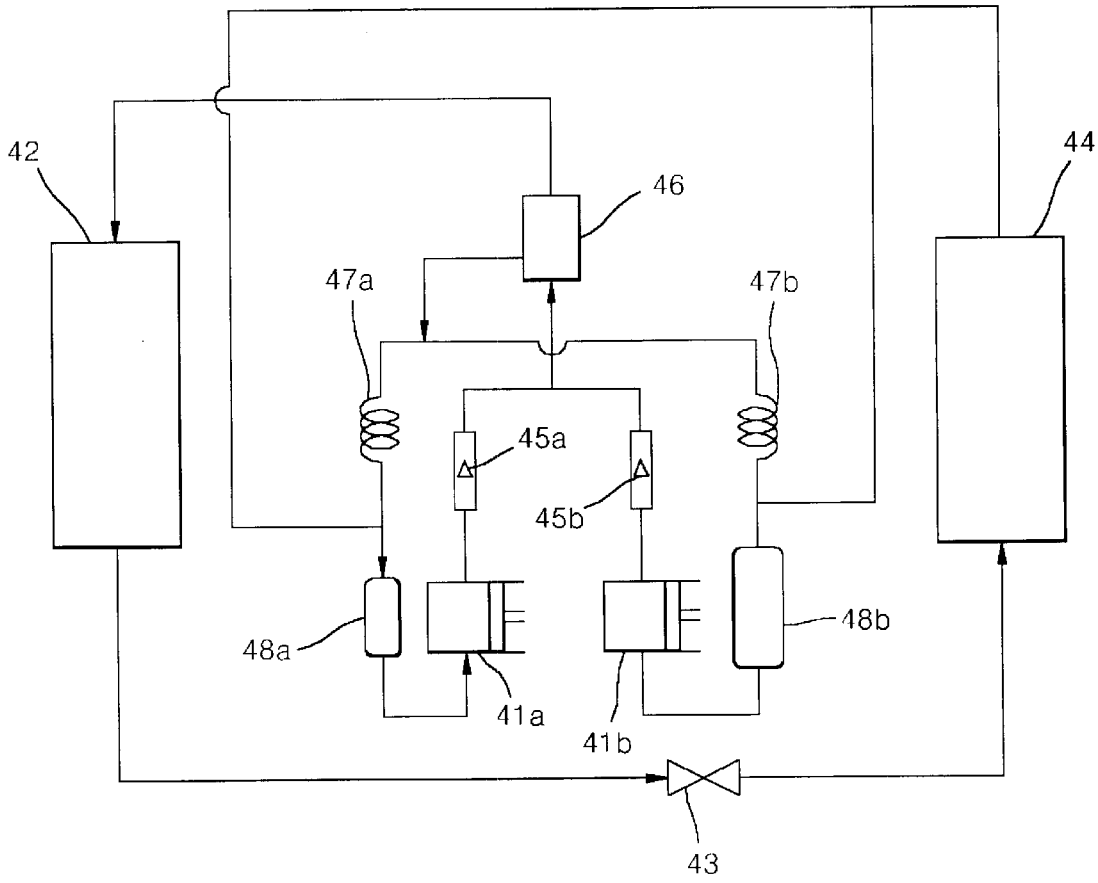
FIG. 3 (BACKGROUND ART)
FIG. 3 is a chart for explaining an actuation of a conventional variable-speed compressor which is equipped with an inverter circuit.
FIG. 4 is a systematic view for illustrating a construction of an air conditioner to which a multi-compressor is applied according to the present invention.

FIG. 4 is a systematic view for illustrating a construction of an air conditioner to which a multi-compressor is applied according to the present invention. While the air conditioner shown in FIG. 4 uses two compressors, it is to be readily understood that a scope of the present invention is not limited by the number of compressors, and therefore, it is possible to use compressors of varying numbers.

Describing a construction of the air conditioner to which the multi-compressor is applied, with reference to FIG. 4, the air conditioner includes two compressors 41*a* and 41*b* for compressing refrigerant, a condenser 42 for removing heat from vaporous refrigerant of high temperature and pressure, which is compressed by the compressors 41*a* and 41*b* so that liquid refrigerant of a high pressure is discharged from the condenser 42, an expander 43 for expanding the liquid refrigerant so that liquid refrigerant of low temperature and pressure is discharged from the expander 43, and an evaporator 44 for evaporating expanded refrigerant and thereby converting it into vaporous refrigerant of low temperature and pressure in a manner such that heat of a room can be absorbed into the system. Due to the fact that the air conditioner has the two compressors 41*a* and 41*b* which can be changed in their compressing capacities, the refrigerant can be compressed to different degrees in conformity with a cooling load, whereby an efficiency of the system can be elevated. Two check valves 45*a* and 45*b* are respectively installed n discharging ends of the compressors 41*a* and 41*b* to prevent he refrigerant which is discharged from the compressors 41*a* and 41*b*, from flowing in a reverse direction. At outlet ends of the check valves 45*a* and 45*b*, there is disposed an oil separator 46. The oil separator 46 functions to prevent oil which is coated on parts located inside the compressors 41*a* and 41*b* to soften actuations of the compressors 41*a* and 41*b*, from being discharged to the outside, so that only vaporous refrigerant is discharged from the compressors 41*a* and 41*b*. The air conditioner further includes accumulators 48*a* and 48*b* which enable pressures to be accumulated before the refrigerant which is discharged from a discharging end of the evaporator 44, divisionally enters the compressors 41*a* and 41*b*. On the other hand, the air conditioner still further includes capillary tubes 47*a* and 47*b* and temperature sensors (thermistors). The capillary tubes 47*a* and 47*b* permit oil which is captured by the oil separator 46 and then depressurized, to be fed back into the accumulators 48*a* and 48*b*. The temperature sensors are arranged inside and outside the air conditioner to sense indoor and outdoor temperatures so that the cooling load of the air conditioner can be determined.

In particular, in the air conditioner, each of the compressors 41 and 41*b*, that is, a multi-compressor, comprises a constant-speed compressor. The number and a kind of the compressors can be varied in a manner such that the compressors are adequately run in response to the cooling load. Therefore, precise control of a room temperature is easily accomplished according to the present invention, which is otherwise accomplished by adopting a costly variable-speed compressor when a cooling load is changed in the conventional art.

In the case that compressors having different compressing capacities are adopted as the compressors 41*a* and 41*b*, it is possible to implement a compressing process in three different modes. That is to say, in a first mode, only a compressor of a high compressing capacity is run. In a second mode, only a compressor of a low compressing capacity is run. Finally, in a third mode, both of the compressors respectively having a high compressing capacity and a low compressing capacity, are simultaneously run. In the case that compressors having the same compressing capacity are adopted as the compressors 41*a* and 41*b*, it is possible to implement a compressing process in two different modes. That is to say, in a first mode, only one compressor is run, and, in a second mode, both of the compressors are run. A person skilled in the art will readily recognize that running modes of compressors can be varied depending upon the number of compressors and a change in compressing capacity.

Figure 5:
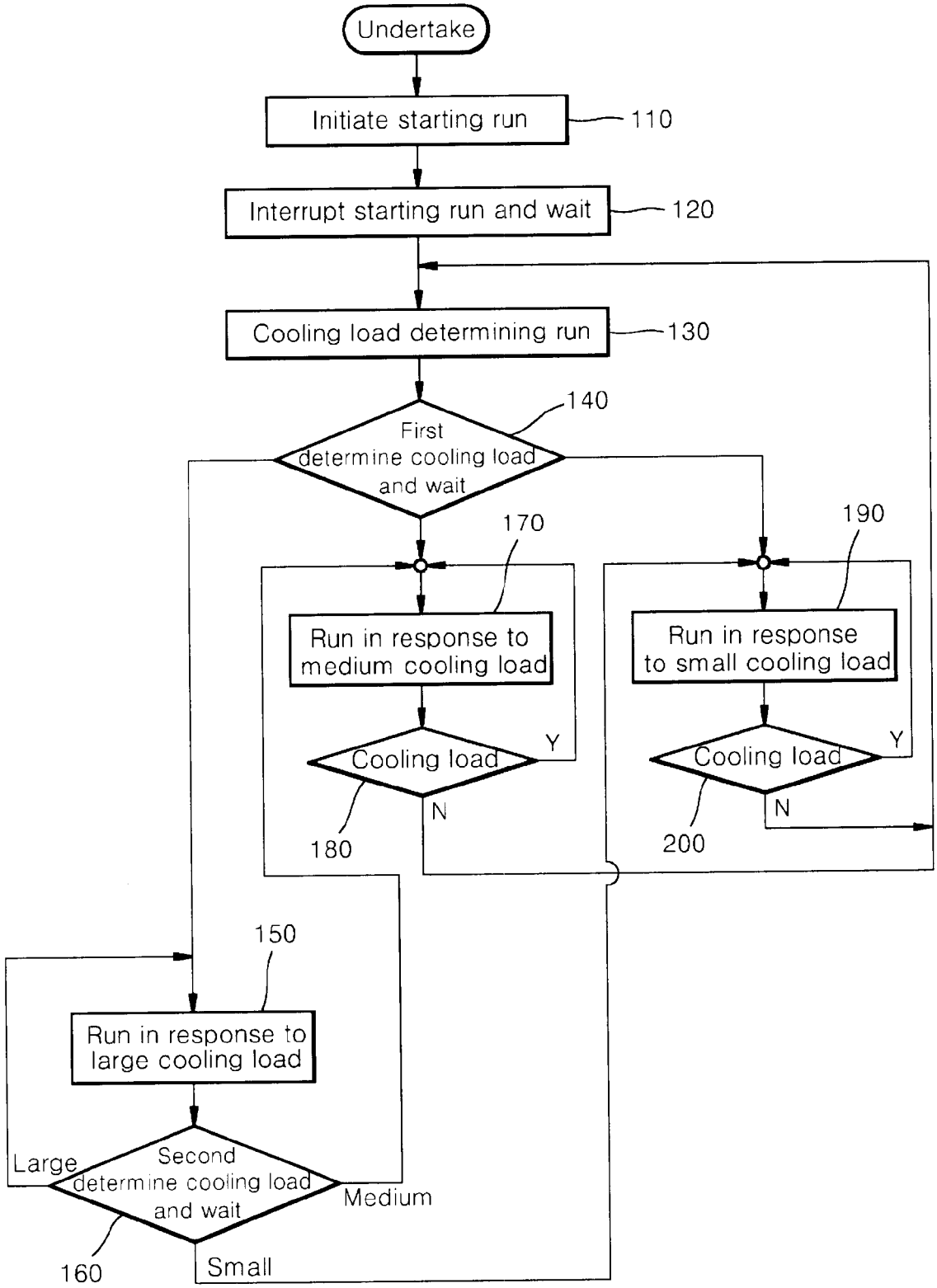
FIG. 5 is a flow chart for explaining a method for controlling the air conditioner to which the multi-compressor is applied, in accordance with an embodiment of the present invention.

FIG. 5 is a flow chart for explaining a method for controlling the air conditioner to which the multi-compressor is applied, in accordance with an embodiment of the present invention. In the following descriptions which will be given in association with FIG. 5, it is deemed that the air conditioner uses two compressors as in the case of FIG. 4.

Hereinafter, concrete steps which constitute a method for controlling the air conditioner having the multi-compressor, will be described with reference to FIG. 5. Initially, as power is supplied to start the air conditioner, starting runs of all the compressors 41*a* and 41*b*, condenser 42 and evaporator 44 are initiated, and thereby, indoor heat is quickly discharged to the outside (step 110) If all the compressors 41*a* and 41*b* are actuated, because indoor heat is quickly discharged to the outside, the user can immediately feel delightfulness and comfortableness.

After all the compressors of the air conditioner are driven, if a room temperature reaches a set temperature which is set in advance by the user or a lower limit temperature which is near the set temperature, for example, lower by 1° C. than the set temperature, the starting runs of both compressors 41*a* and 41*b* are interrupted, and, as the air conditioner is maintained in a standby state, a room temperature rises (step 120).

If the starting runs of the compressors 41*a* and 41*b* are interrupted, indoor heat is not discharged to the outside. However, because outdoor heat is transferred to the inside, a room temperature rises. If a room temperature reaches the set temperature or an upper limit temperature which is near the set temperature, for example, higher, by 1° C., than the set temperature, all of the compressors are actuated again to effectuate a cooling load determining run (step 130). That is to say, in effectuating the cooling load determining run, all the compressors 41*a* and 41*b* are actuated at the upper limit temperature which is higher than the set temperature by a preset value, for example, 1° C., and the actuations of all the compressors 41*a* and 41*b* for determining a cooling load are interrupted at the lower limit temperature which is lower than the set temperature by a preselected value, for example, 1° C. By this, an on-time for which the two compressors are run to decrease a room temperature by a predetermined value, is measured, and, in this way, data which can be used for determining a cooling load of the room, are obtained.

Here, as the data for determining a cooling load of the room, in addition to the on-time of the compressors, a difference between indoor and outdoor temperatures can be adopted. In other words, by measuring a difference between indoor and outdoor temperatures using the temperature sensors, it is possible to determine a cooling load of the room in a more precise manner.

Further, because it is sufficient that a predetermined temperature range for determining a cooling load is defined, a relationship among the set temperature, the upper limit temperature and the lower limit temperature can be adequately established so long as the set temperature is intervened between the upper limit temperature and the lower limit temperature. In particular, it can be contemplated that one of the upper limit temperature and the lower limit temperature is equal to the set temperature.

If the cooling load determining run is effectuated and the data for determining a cooling load of the room at a given time are obtained, a cooling load is first determined based on the on-time of the compressors and the difference between indoor and outdoor temperatures, so as to decide at least one compressor to be driven. Also, in order to ensure that the compressors are safely run, a predetermined time is elapsed in a standby state (step 140).

Concretely describing how a cooling load is determined in the first cooling load determining and waiting step 140, in the present invention, in order to determine a cooling load, in addition to a difference between indoor and outdoor temperatures, an on-time of at least one compressor is used.

A difference between indoor and outdoor temperatures forms basic data for determining a cooling load. If a difference between indoor and outdoor temperatures is substantial, when considering a general law dominating heat transfer, a cooling load of the room is judged to be large. If a difference between indoor and outdoor temperatures is small, a cooling load of the room is judged to be small.

Also, if an on-time of at least one compressor is long, a cooling load of the room is judged to be large, and, if an on-time of at least one compressor is short, a cooling load of the room is judged to be small.

The reason why an on-time of at least one compressor is used as data for determining a cooling load, is to correct an error which may be caused under the case where sunlight is directly irradiated on an outdoor temperature sensor, a temperature is measured to be excessively high and thereby a cooling load is judged to be overly large. Further, the reason is to allow various external factors, such as changes, from hour to hour, in the number of persons being in the room, in power consumption of electrical appliances like a refrigerator, located in the room, and in amount of room air ventilation, to be considered upon determining a cooling load.

Figure 6:
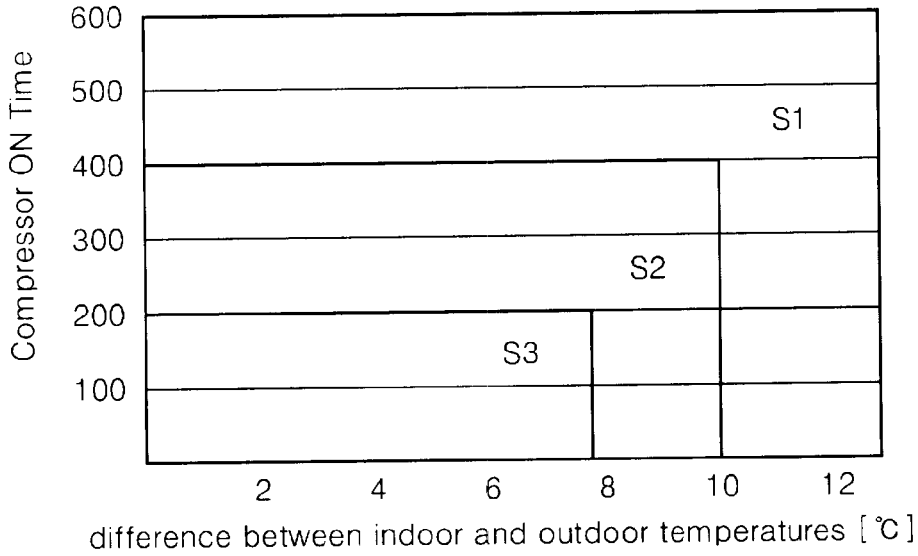
FIG. 6 is a graph employed for determining a cooling load based on measured data.

FIG. 6 is a graph employed for determining a cooling load based on measured data.

Referring to FIG. 6, it is to be readily understood that, by using two compressors which have different compressing capacities, three running modes can be provoked. In a first mode in which an on-time of at least one compressor is no less than 400 seconds and a difference between indoor and outdoor temperatures is no less than 10° C., other data are disregarded and all of the two compressors are run (see the region S1) . In a second mode in which an on-time of at least one compressor is 200 to 400 seconds and a difference between indoor and outdoor temperatures is 0° C. to 10° C., and an one-time of at least one compressor is 0 to 200 seconds and a difference between indoor and outdoor temperatures is 8° C. to 10° C., only the one compressor having a large compressing capacity is run (see the region S2). In a third mode in which an on-time of at least one compressor is no less than 200 seconds and a difference between indoor and outdoor temperatures is 0° C. to 8° C., only the other compressor having a small compressing capacity is run (see the region S3). Due to the fact that at least one compressor is chosen and run in conformity with a cooling load in this way, power consumption can be reduced.

Successively describing the method for controlling the air conditioner having the multi-compressor according to the present invention with reference to FIG. 5, after a cooling load is determined in the first cooling load determining and waiting step 140 based on an on-time of at least one compressor and a difference between indoor and outdoor temperatures and thereby at least one compressor is chosen, a first procedure of the method for controlling the air conditioner is completed, and a second procedure for running at least one compressor in response to a cooling load is undertaken.

If it is determined in the first cooling load determining and waiting step 140 that a cooling load is large, it is necessary to run all of the two compressors 41*a* and 41*b*. Runs of the two compressors 41*a* and 41*b* in a state wherein a cooling load is large, that is, runs in response to a large cooling load, is effected in a manner similar to the first cooling load-determining running step 130. Stating in further detail the runs in response to a large cooling load, after at least one compressor is deactuated at the lower limit temperature which is less than the set temperature, in the first cooling load-determining running step 130, as a room temperature rises and reaches the upper limit temperature which is greater than the set temperature, runs of all the two compressors 41*a* and 41*b* are started, and, when a room temperature reaches the lower limit temperature which is lower than the set temperature, the two compressors are deactuated. At this time, an on-time of the compressors is measured in a manner such that a cooling load can be determined again. In this way, the runs in response to a large cooling load are completed (step 150).

After data for determining again a cooling load are obtained in the large cooling load-responding running step 150, as in the first cooling load determining and waiting step 140, a cooling load is second determined again based on an on-time of the large cooling load-responding running step 150 and a difference between indoor and outdoor temperatures (step 160).

The reason why a cooling load is second determined in the second cooling load determining step 160 as described above, is that, while a room temperature approaches a temperature set in advance by the user when the air conditioner is initially operated, a thermally steady state is not still effected in a wall which partitions indoor and outdoor spaces from each other. In other words, at an initial operating stage of the air conditioner, because a great amount of heat is accumulated in the wall, a cooling load which is larger than an actual cooling load, is determined for some time.

Even though the compressors are continuously run under the large cooling load-responding running step 150, if a room temperature does not reach the lower limit temperature which is less than the set temperature, because a cooling load has been markedly increased due to some causes such as a temperature change, all of the two compressors must be continuously run.

In the meanwhile, if it is determined in the first cooling load-determining and waiting step 140 that a cooling load is medium, it is proper to use only one compressor of the two compressors 41*a* and 41*b* which one compressor has a large compressing capacity. By this, one compressor which has a large compressing capacity, is driven (step 170). If it is determined in the first cooling load determining and waiting step 140 that a cooling load is small, it is proper to use only the other compressor of the two compressors 41*a* and 41*b* which the other compressor has a small compressing capacity. By this, the other compressor which has a small compressing capacity, is driven (step 190). Further, if it is determined in the second cooling load determining step 160 that a cooling load is medium or small, depending upon a cooling load, the method proceeds in a manner such that the one compressor or the other compressor of the two compressors 41*a* and 41*b* is run under a medium cooling load-responding running step 170 or a small cooling load-responding running step 190.

In the medium cooling load-responding running step 170 or the small cooling load-responding running step 190, the individual compressor is run. In the steps 170 and 200, a cooling load is not determined, and instead, a room temperature is measured at a predetermined period while the individual compressor is run, so that propriety of a running status of the compressor is checked (step 180 or step 200). Describing in further detail the compressor run-checking step 180 or 190, when it is judged that a cooling load is adequate in consideration of a measured indoor temperature, that is, a room temperature, a current running status of the compressor is maintained. On the contrary, when it is judged that a room temperature successively rises and proper cooling is not accomplished, a program returns to the first cooling load-determining running step 130 so that a cooling load of the room can be determined.

Hereinbelow, the case where it is judged in the compressor run-checking step 180 or 200 as stated above, that a running situation of the compressor is not adequate in consideration of a cooling load, will be illustratively described. While the one compressor having a large compressing capacity or the other compressor having a small compressing capacity is run to discharge indoor heat to the outside, if a room temperature abruptly rises or falls and goes beyond the range between the upper limit temperature which is greater than the set temperature and the lower limit temperature which is less than the set temperature, a cooling load is determined again so that a room temperature can be properly adjusted. However, preferably, a cooling load is appropriately determined so that a room temperature is maintained within the range and a hunting phenomenon of a room temperature does not occur while the one or the other compressor is driven, whereby delightfulness or comfortableness of the user is improved. In the case that the one compressor having a large compressing capacity or the other compressor having a small compressing capacity is independently run, propriety of a running status of the compressor is checked as described above. In this connection, while it is the norm that a period of checking the propriety varies depending upon a compressing capacity of the compressor, the period is generally set to 3 minutes.

Meanwhile, if it is judged again in the second cooling load determining and waiting step 160 that a cooling load is large, the program proceeds to the large cooling load-responding running step 150 so as to continuously run the compressors. If it is judged again in the second cooling load determining and waiting step 160 that a cooling load is medium, the program proceeds to the medium cooling load-responding running step 170 so as to run only the one compressor having a large compressing capacity. If it is judged again in the second cooling load determining and waiting step 160 that a cooling load is small, the program proceeds to the small cooling load-responding running step 190 so as to run only the other compressor having a small compressing capacity.

In the above descriptions, the preferred embodiment of the method for controlling an air conditioner to which a multi-compressor is applied, according to the present invention, was illustrated. In order to improve operating performance and reliability of the air conditioner according to the present invention, a problem which is caused by oil discharge from a compressor upon controlling the air conditioner to which the multi-compressor is applied, can be coped with. That is to say, in the case that the one compressor having a large compressing capacity or the other compressor having a small compressing capacity is independently run, in order to prevent lubricating oil from flowing into the opposing compressor 41*a* or 41*b* which is not run, through the check valve 45*a* or 45*b*, even though a room temperature is maintained within the range between the upper limit temperature and the lower limit temperature, if a predetermined time is lapsed, it is preferred that the program proceeds to the first cooling load-determining running step 130 to let the two compressors be simultaneously run.

Also, as another means for coping with the problem which is caused by oil discharge out of the compressors, although a cooling load is determined so that only a compressor is run, in an initial driving stage, all of the two compressors are run. Then, after the system is stabilized, that is, maintained under a steady state, at least one compressor which is chosen based on a cooling load, is actuated. In this way, breakdowns of the compressors, which can be otherwise caused by oil shortage, can be avoided.

Figure 7:
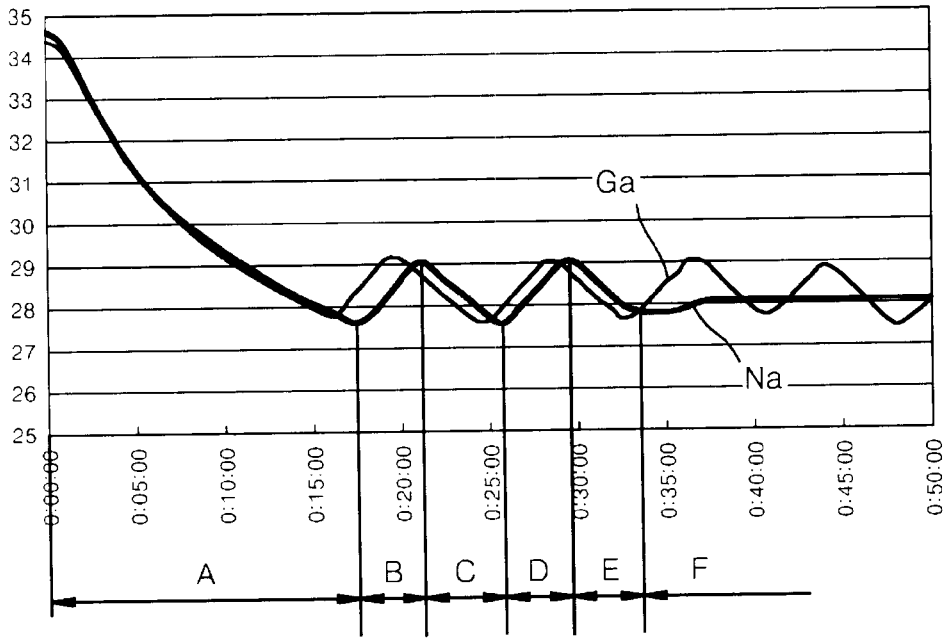
FIG. 7 is a graph for comparing an operation of the air conditioner having applied thereto the multi-compressor according to the present invention with that of the conventional air conditioner having applied thereto the constant-speed compressor.

FIG. 7 is a graph for comparing an operation of the air conditioner having applied thereto the multi-compressor according to the present invention with that of the conventional air conditioner having applied thereto the constant-speed compressor.

Referring to FIG. 7, in the conventional air conditioner to which the constant-speed compressor is applied, while a temperature is controlled within a predetermined temperature range on the basis of a set temperature, a hunting phenomenon periodically occurs. In this regard, the line 'Ga' denotes a room temperature change in the conventional air conditioner to which the conventional constant-speed compressor is applied. On the contrary, the line 'Na' denotes a room temperature change in the air conditioner which is controlled using the multi-compressor according to the present invention. In FIG. 7, the section A represents an initial starting running step 110 in which the user starts to run the compressors to decrease a room temperature to the set temperature. The section B represents an initial starting run interrupting and waiting step 120 in which the initial starting runs of the compressors are interrupted. The section C represents the first cooling load-determining running step 130 in which a cooling load of the room is determined. Through the section C, an on-time of the compressors is measured to be used as data for determining a cooling load. The section D represents the first cooling load determining and waiting step 140 in which a cooling load is determined on the basis of data measured in the first cooling load-determining running step 130. The section E represents the large cooling load-responding running step 150 in which all of the two compressors are run when a cooling load is judged to be large in the first cooling load determining and waiting step 140. In the section F, a cooling load is determined again on the basis of the data such as an on-time of the compressors, measured for determining the cooling load, in a manner such that at least one compressor is newly chosen to allow the chosen compressor to be steadily actuated. A person skilled in the art will readily recognize that the at least one compressor is not run in this way under all circumstances. As the case may be, in the section D, that is, in the first cooling load determining and waiting step 140, a cooling load can be differently determined, so that different combinations of compressors can be run. It is to be noted that, while compressors are continuously run, at least one compressor can be run in different ways on all such occasions, depending upon a concrete change in cooling load.

Thereafter, at least one compressor is chosen in obedience to a change in cooling load, that is, on the basis of the fact that a cooling load is large, medium or small. In FIG. 7, it is illustrated that th e one compressor having a large compressing capacity or the other compressor having a small compressing capacity is chosen and run. It is not deemed that this horizontal temperature change is maintained. Instead, depending upon various external factors, such as changes in the number of persons being in the room, in power consumption of electrical appliances like a refrigerator, located in the room, and in amount of room air ventilation, a cooling load varies. As a consequence, a running status of at least one compressor is continuously checked in sequences as described above, to confirm whether the running status is adequate in consideration of a cooling load which varies from hour to hour. Therefore, due to the fact that a combination of at least one compressor is chosen to optimally suited to a cooling load, a hunting phenomenon can be avoided, and it is possible to use energy in a more efficient manner.

By experiments, it was found that, when a set temperature is 28° C. and a running time is 50 minutes, the conventional air conditioner to which the constant-speed compressor is applied and the present air conditioner to which the multi-compressor is applied, have power consumption of 1672 Wh and 1562 Wh, respectively.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method for controlling an air conditioner having a multi-compressor, comprising the steps of:

first determining, in order to accomplish a set temperature after a user starts the air conditioner, a cooling load of a room by measuring an on-time for which at least two compressors are run, in a manner such that the more the on-time of the compressors is long, the more the cooling load of the room is judged to be large; and operating the air conditioner by changing a compressing capacity of the compressors in response to a first determined cooling load, in a manner such that, when the cooling load is large, the air conditioner is operated by a first combination of compressors, having a large compressing capacity, and, when the cooling load is small, the air conditioner is operated by a second combination of compressors, having a small compressing capacity.

2. The method as claimed in claim 1, wherein, in the first cooling load determining step, the on-time of the compressors is measured between an upper limit temperature and a lower limit temperature which are respectively greater and less than the set temperature which is wanted by the user to be accomplished, so that the cooling load can be precisely determined.

3. The method as claimed in claim 1, wherein, before the on-time of the compressors is measured in the first cooling load determining step, the method comprises the steps of:

initiating starting runs of at least two compressors when the user starts the air conditioner; and interrupting the starting runs of at least two compressors when a room temperature reaches a lower limit temperature which is less than the set temperature, and then, waiting.

4. The method as claimed in claim 1, wherein, when the first determined cooling load is large and thereby, all of said at least two compressors should be run, the air conditioner operating step comprises the sub-steps of:

running the at least two compressors only until a room temperature falls from an upper limit temperature which is greater than the set temperature to a lower limit temperature which is less than the set temperature in the first cooling load determining step, and second determining a cooling load of the room by measuring an on-time for which the at least two compressors are run; and calculating a cooling capacity of the compressors depending upon a second determined cooling load.

5. The method as claimed in claim 1, wherein, when the first determined cooling load is small and thereby, it is not necessary to run all of said at least two compressors, the air conditioner operating step comprises the sub-step of:

measuring a room temperature at a predetermined period while at least one compressor is run, and returning to the first cooling load determining step when a measured room temperature goes beyond a range between an upper limit temperature which is greater than the set temperature and a lower limit temperature which is less than the set temperature.

6. The method as claimed in claim 1, wherein each of the first and second combinations of compressors is one of subsets of all compressors.

7. A method for con trolling an air conditioner having a multi-compressor, comprising the steps of:

first determining, in order to accomplish a set temperature after a user starts the air conditioner, a cooling load of a room by measuring an on-time for which all of two compressors having the s same compressing capacity or different compressing capacities are run, in a manner such that the more the on-time of the compressors is long, the more the cooling load of the room is judged to be large; and operating the air conditioner by changing a compressing capacity of the compressors in response to a first determined cooing load, in a manner such that, when the cooling load is large, the air conditioner is operated by a first combination of compressors, having a large compressing capacity, and, when the cooling load is small, the air conditioner is operated by a second combination of compressors, having a small compressing capacity.

8. The method as claimed in claim 7, wherein, in the first cooling load determining step, the on-time of the compressors is measured in a predetermined temperature range between an upper limit temperature and a lower limit temperature which are respectively greater and less than the set temperature, and the set temperature lies within the predetermined temperature range.

9. The method as claimed in claim 7, wherein, before the on-time of the compressors is measured in the first cooling load determining step, the method comprises the steps of:

initiating starting runs of the two compressors when the user starts the air conditioner; and interrupting the starting runs of the two compressors when a room temperature reaches the lower limit temperature which is less than the set temperature, and then, waiting.

10. The method as claimed in claim 7, wherein, when the first determined cooling load is large and thereby, all of the two compressors are run, the air conditioner operating step comprises the sub-steps of:

running the two compressors only until a room temperature falls from an upper limit temperature which is greater than the set temperature to a lower limit temperature which is less than the set temperature in the first cooling load determining step, and second determining a cooling load of the room by measuring an on-time for which the two compressors are run; and calculating a cooling capacity of the compressors depending upon a second determined cooling load.

11. The method as claimed in claim 7, wherein, when the first determined cooling load is small and thereby, it is not necessary to run all of the two compressors, the air conditioner operating step comprises the substep of:

measuring a room temperature at a predetermined period while at least one compressor is run, and returning to the first cooling load determining step when a measured room temperature goes beyond a range between an upper limit temperature which is greater than the set temperature and a lower limit temperature which is less than the set temperature.

12. The method as claimed in claim 7, wherein, before the first cooling load determining step, all of the two compressors are run in a manner such that a room can be quickly cooled at an initial running stage.

13. A method for controlling an air conditioner having a multi-compressor, comprising the steps of:

running at least two compressors until a room temperature falls from an upper limit temperature which is no less than a set temperature set in advance by a user to a lower limit temperature which is no greater than the set temperature, and first determining a cooling load of a room by measuring an on-time for which the at least two compressors are run and a difference between indoor and outdoor temperatures; and operating the air conditioner by changing a compressing capacity of the compressors in response to the cooling load determined in the first cooling load determining step, in a manner such that, when the cooling load is large, the air conditioner is operated by a first combination of compressors, having a large compressing capacity, and, when the cooling load is small, the air conditioner is operated by a second combination of compressors, having a small compressing capacity, whereby power consumption is reduced.

14. The method as claimed in claim 13, wherein, in the first cooling load determining step, when the on-time of the compressors is long, the cooling load of the room is judged to be large, and, when the on-time of the compressors is short, the cooling load of the room is judged to be small.

15. The method as claimed in claim 13, wherein, in the first cooling load determining step, when the difference between the indoor and outdoor temperatures is substantial, the cooling load of the room is judged to be large, and, when the difference between the indoor and outdoor temperatures is insubstantial, the cooling load of the room is judged to be small.

16. The method as claimed in claim 13, wherein, in the first cooling load determining step, the on-time of the compressors is measured between the upper limit temperature and the lower limit temperature which are respectively no less and no greater than the set temperature, so that the cooling load can be precisely determined.

17. The method as claimed in claim 13, wherein, before the on-time of the compressors is measured in the first cooling load determining step, the method comprises the steps of:

initiating starting runs of at least two compressors when the user starts the air conditioner; and interrupting the starting runs of said at least two compressors when a room temperature reaches the lower limit temperature which is no greater than the set temperature, and then, waiting.

18. The method as claimed in claim 13, wherein, when the first determined cooling load is large and thereby, all of at least two compressors should be run, the air conditioner operating step comprises the sub-steps of:

running the at least two compressors only until a room temperature falls from the upper limit temperature which is no less than the set temperature to the lower limit temperature which is no greater than the set temperature as in the case of the first cooling load determining step, and second determining a cooling load of the room by measuring an on-time for which the at least two compressors are run; and calculating a cooling capacity of the compressors depending upon a second determined cooling load.

19. The method as claimed in claim 13, wherein, when the first determined cooling load is small and thereby, it is not necessary to run all of at least two compressors, the air conditioner operating step comprises the sub-step of:

measuring a room temperature at a predetermined period while at least one compressor is run, and returning to the first cooling load determining step when a measured room temperature goes beyond a range between the upper limit temperature which is no less than the set temperature and the lower limit temperature which is no greater than the set temperature.

20. The method as claimed in claim 13, wherein each of the first and second combinations of compressors is one of subsets of all compressors.

* * * * *